United States Patent [19]

Köhler et al.

[11] Patent Number: 4,599,110

[45] Date of Patent: Jul. 8, 1986

[54] PROCESS FOR THE PRODUCTION OF VALVE SEAT RINGS

[75] Inventors: Michael Köhler, Wetter-Wengern; Wolfgang Petry, Bochum, both of Fed. Rep. of Germany

[73] Assignee: Bleistahl G.m.b.H., Wetter-Wengern, Fed. Rep. of Germany

[21] Appl. No.: 721,888

[22] Filed: Apr. 11, 1985

[30] Foreign Application Priority Data

Apr. 11, 1984 [DE] Fed. Rep. of Germany ..... 3413593

[51] Int. Cl.[4] ..... C22C 29/00

[52] U.S. Cl. ..... 75/243; 29/157.1 R; 29/156.7 R; 29/156.7 A; 75/246; 75/252; 75/255; 75/123 K; 75/231; 148/126.1; 148/127; 418/178; 418/179; 419/5; 419/14; 419/26; 419/28; 419/30; 419/66; 419/46; 251/359

[58] Field of Search ..... 419/5, 14, 26, 28, 30, 419/66; 75/231, 243, 246, 252, 255, 123 K; 148/126.1, 127; 29/157.1 R, 156.7 R, 156.7 A; 418/178, 179; 251/359

[56] References Cited

U.S. PATENT DOCUMENTS 3,918,923 11/1975 Inoue ..... 419/11

4,204,031 5/1980 Takemura et al. ..... 419/11

*Primary Examiner*—Stephen J. Lechert, Jr.

*Attorney, Agent, or Firm*—Thomas H. Murray

[57] ABSTRACT

A process for the production of valve seat rings by powder metallurgy wherein molybdenum disulfide in the range of about 0.5% to 1.5% by weight is added to a powder mixture containing 0.8% to 1.5% by weight graphite, 1.0% to 4% by weight lead, 0.5% to 5% by weight nickel, 1.2% to 1.8% by weight molybdenum, 9.6% to 14.4% by weight cobalt, and the remainder iron. The resulting powder mixture is pressed into valve seat rings at a pressing force between 40 and 60 and preferably 50 KN/cm$^2$. The rings are then sintered in a neutral atmosphere at a temperature of 1100° C. to 1200° C., finally compressed at a pressing force above 120 KN/cm$^2$ and heat-treated if required. The resulting valve seat rings have greatly improved wear properties when used in internal combustion engines using lead-free gasoline.

3 Claims, No Drawings

PROCESS FOR THE PRODUCTION OF VALVE SEAT RINGS

BACKGROUND OF THE INVENTION

In U S. Pat. No. 3,471,343 a process for producing valve seat rings by powder metallurgy techniques is described. In the patented process, a powder mixture containing 0.8% to 1.5% by weight graphite, 1.0% to 4% by weight lead, 0.5% to 5% by weight nickel, 1.2% to 1.8% by weight molybdenum, 9.6% to 14.4% by weight cobalt, and the remainder iron, is pressed into valve seat rings for internal combustion engines and the like at a pressing force between about 40 and 60 $KN/cm^2$ (1000 newtons per square centimeter). The pressed rings are then sintered in a neutral atmosphere at a temperature of about 1100° C. to 1200° C. and finally compressed at a pressing force above 120 $KN/cm^2$ and, if required, heat-treated. The final compression may be a hot or cold compression and may be carried out by heating the valve seat rings after compression for 15 minutes to a temperature above the $AC_3$ point, then cooling them and tempering them for 30 minutes at a temperature of about 600° C.

Valve seat rings made by the process described in the aforesaid U.S. Pat. No. 3,471,343 have increased hot strength and are used for internal combustion engine exhaust valves. The hardness of the material is about 320 Brinell at room temperature and 205 Brinell at a temperature of 600° C. However, the valve seat rings of the type described above, when manufactured in accordance with prior-art techniques, have a limited useful life when used in engines operated with lead-free fuel.

SUMMARY OF THE INVENTION

In accordance with the present invention, a new and improved process is provided for the production of valve seat rings by powder metallurgy techniques whereby the life of the valve seat rings is increased when used in engines operated with lead-free fuel.

Specifically, the invention resides in the realization that by adding about 0.5% to 1.5% by weight molybdenum disulfide to the initial powder mixture described above, the wear properties of the resulting valve seat rings are greatly improved in comparison with valve seat rings which do not include molybdenum disulfide.

It is, of course, known to add molybdenum disulfide to powder metallurgy mixtures for the production of bushing bearings and the like. In the case of bearings, however, the addition is made solely to improve the anti-friction or sliding properties of the bushing, the improvement being due to the fact that each lamella of the molybdenum disulfide is so formed that a plane of molybdenum atoms is situated between two planes of sulfur atoms. The result is a lamellar crystal structure similar to that of graphite. In the production of known bushing bearings with a molybdenum disulfide addition, therefore, sintering must be carried out at a temperature at which the molybdenum disulfide does not decompose in order to obtain the desired anti-friction properties.

DETAILED DESCRIPTION OF THE INVENTION

In carrying out the invention, molybdenum disulfide is added in quantities of 0.5% to 1.5% by weight of the aforesaid powder mixture containing 0.8% to 1.5% by weight graphite, 1.0% to 4% by weight lead, 0.5% to 5% by weight nickel, 1.2% to 1.8% by weight molybdenum, 9.6% to 14.4% by weight cobalt, and the remainder iron. As in prior-art techniques, the metal powder mixture is then pressed into valve seat rings at a pressing force between 40 and 60, and preferably 50 $KN/cm^2$ and then sintered in a neutral atmosphere at a temperature of 1100° C. to 1200° C. and compressed at a pressing force above 120 $KN/cm^2$. If required, the finished rings can then be heat-treated.

Rings produced in accordance with the invention have densities of from 7.4 to 7.6 $g/cm^2$ and hardnesses of from 300 to 500 Brinell. When used in endurance testing in internal combustion engines operated with lead-free gasoline, the exhaust valve seat ring shows greatly improved wear properties in comparison with mass-produced valve seat rings produced in accordance with the prior art.

By heating the powder mixture at a temperature above the $AC_3$ point, the molybdenum disulfide disintegrates in the sintering process and forms new compounds by interaction with the cobalt contained in the material. The compounds formed are not completely known; but photomicrographs clearly show that the homogeneous distribution of the cobalt powder in the sintered material is much better than when an initial mixture is used without molybdenum disulfide. In addition to being useful in internal combustion engines operated with lead-free gasoline, the valve seat rings of the invention also show improved performance in turbocharged Diesel engines in terms of wear, particularly when used at the intake valves.

Although the invention has been shown in connection with a certain specific embodiment, it will be readily apparent to those skilled in the art that various changes in composition and method steps may be made to suit requirements without departing from the spirit and scope of the invention.

We claim as our invention:

1. In the process for the production of sintered valve seat rings wherein a powder mixture containing 0.8% to 1.5% by weight graphite, 1.0% to 4% by weight lead, 0.5% to 5% by weight nickel, 1.2% to 1.8% by weight molybdenum, 9.6% to 14.4% by weight cobalt, and the remainder iron, is pressed into valve seat rings at a pressing force of between 40 and 60 $KN/cm^2$ and are then sintered in a neutral atmosphere at a temperature of 1100° C. to 1200° C. and finally compressed at a pressing force above 120 $KN/cm^2$;

the improvement in said process comprising adding to said powder mixture about 0.5% to 1.5% by weight molybdenum disulfide, whereby the molybdenum disulfide will disintegrate when sintering and form new compounds improving the homogeneous distribution of the cobalt powder in the sintered material.

2. The process of claim 1 wherein said powder mixture is pressed into valve seat rings at a pressing force of 50 $KN/cm^2$.

3. An article of manufacture as is produced by the process of claim 1.

* * * * *